US008066365B2

(12) United States Patent
Sekimoto et al.

(10) Patent No.: US 8,066,365 B2
(45) **Date of Patent: *Nov. 29, 2011**

(54) IMAGE FORMING APPARATUS AND IMAGE FORMING METHOD

(75) Inventors: Masahiko Sekimoto, Kanagawa (JP); Ken Hashimoto, Kanagawa (JP); Hiroshi Ikeda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 395 days.

This patent is subject to a terminal disclaimer.

(21) Appl. No.: 12/365,224

(22) Filed: Feb. 4, 2009

(65) Prior Publication Data

US 2010/0073407 A1 Mar. 25, 2010

(30) Foreign Application Priority Data

Sep. 24, 2008 (JP) ..... 2008-244699

(51) Int. Cl.
*B41J 2/01* (2006.01)
*B41J 2/015* (2006.01)

(52) U.S. Cl. ..... 347/103; 347/101; 347/102; 347/21

(58) Field of Classification Search ..... 347/103
See application file for complete search history.

(56) References Cited

U.S. PATENT DOCUMENTS 4,362,273 A * 12/1982 Seino et al. ..... 239/128
6,308,033 B1 * 10/2001 Kato ..... 430/118.5
6,353,716 B1 * 3/2002 Uehara et al. ..... 399/44
6,402,317 B2 * 6/2002 Yanagawa et al. ..... 347/104
6,422,696 B1 * 7/2002 Takahashi et al. ..... 347/103
6,856,778 B2 * 2/2005 Vejtasa et al. ..... 399/237
2005/0238838 A1 * 10/2005 Doi et al. ..... 428/64.4
2006/0284951 A1 * 12/2006 Ikeda et al. ..... 347/103
2007/0176995 A1 * 8/2007 Kadomatsu et al. ..... 347/103
2010/0066771 A1 * 3/2010 Hiratsuka et al. ..... 347/1

FOREIGN PATENT DOCUMENTS

JP 2000-158795 6/2000
JP 2000-351264 12/2000
JP 2001-010225 1/2001

* cited by examiner

*Primary Examiner* — Laura Martin
*Assistant Examiner* — Jeremy Bishop
(74) *Attorney, Agent, or Firm* — Fildes & Outland, P.C.

(57) ABSTRACT

An image forming apparatus that includes: an intermediate transfer member; an ink absorbing particle supplying unit for supplying ink absorbing particles on a surface of the intermediate transfer member; an ink ejecting unit for ejecting ink to the ink absorbing particles; a transfer unit for transferring the ink absorbing particles to a recording medium; a fixing unit for fixing the transferred ink absorbing particles onto the recording medium; a particle collecting unit for collecting remaining ink absorbing particles on the intermediate transfer member; a humidity reducing unit for reducing humidity around the collected ink absorbing particles; and a particle supplying unit for supplying the ink absorbing particles with humidity reduced by the humidity reducing unit.

10 Claims, 9 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2008-244699 filed on Sep. 24, 2008.

BACKGROUND (i) Technical Field

The present invention relates to an image forming apparatus and a method for forming an image.

(ii) Related Art

Conventionally, there has been known an image forming apparatus that forms an image by supplying a surface of a rotating intermediate transfer member having no ends, with ink absorbing particles that absorb ink; and by ejecting the ink in accordance with an image signal to the ink absorbing particles supplied on the surface of the intermediate transfer member such that the ink absorbing particles absorb the ink.

SUMMARY

According to an aspect of the invention, there is provided an image forming apparatus, which includes:

an intermediate transfer member;

an ink absorbing particle supplying unit that supplies ink absorbing particles on a surface of the intermediate transfer member;

an ink ejecting unit that ejects ink in accordance with an image signal, to the ink absorbing particles supplied on the surface of the intermediate transfer member;

a transfer unit that transfers the ink absorbing particles that have absorbed the ink ejected on the intermediate transfer member from the ink ejecting unit to a recording medium, the transfer unit being disposed on a downstream side from the ink ejecting unit along a rotating direction of the intermediate transfer member;

a fixing unit that fixes the ink absorbing particles transferred to the recording medium on the recording medium;

a particle collecting unit that collects remaining ink absorbing particles on the intermediate transfer member, the particle collecting unit being disposed on a downstream side from the image transfer unit along the rotating direction of the intermediate transfer member;

a humidity reducing unit that reduces relative humidity around the ink absorbing particles collected by the particle collecting unit; and a collected particle supplying unit that supplies the collected ink absorbing particles with humidity reduced by the humidity reducing unit to the ink absorbing particle supplying unit.

BRIEF DESCRIPTION OF THE DRAWINGS

Exemplary embodiments of the present invention will be described in detail based on the following figures, wherein.

DETAILED DESCRIPTION

Figure 1:
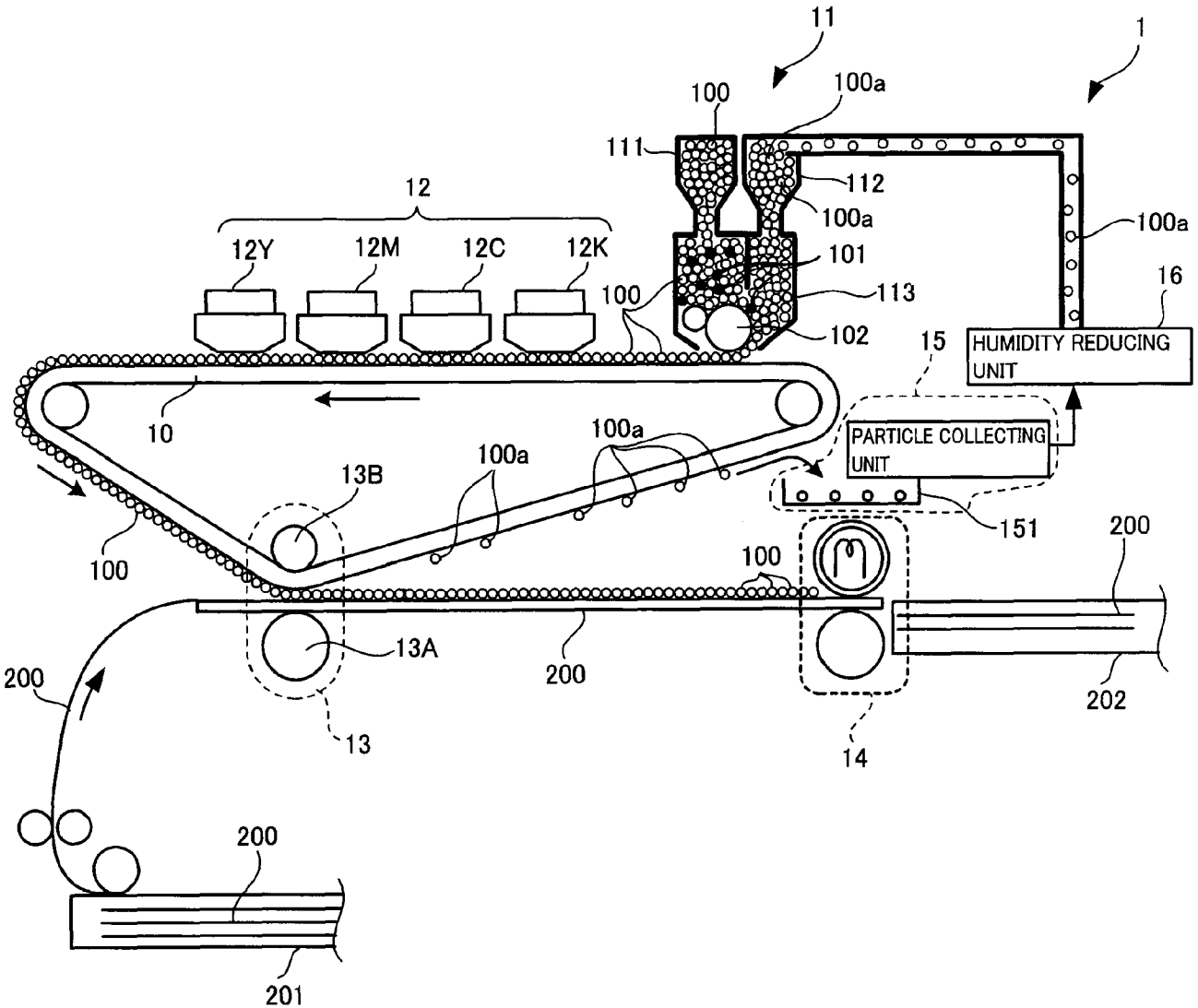
FIG. 1 is a diagram showing an exemplary embodiment of an image forming apparatus 1 in the present invention.

FIG. 1 is a diagram showing an image forming apparatus 1 as an exemplary embodiment of the present invention.

In the image forming apparatus 1 illustrated in FIG. 1, there is an intermediate transfer member 10 in the shape of a belt having no ends (hereinafter, it is simply called as a belt 10) that rotates in the direction of the arrow. There are also an ink absorbing particle supplying unit 11 that supplies ink absorbing particles 100 on the belt and arranges them in two dimensions, and an inkjet recording head 12 as an example of an ink ejecting unit that ejects ink on the ink absorbing particles 100 arranged on the belt 10 in two dimensions. Further, there are an image transfer unit 13 that transfers the two-dimensionally arranged ink absorbing particles 100 on which an image is formed with the use of the ink ejected from the inkjet recording head 12, to a recording medium 200, and a fixing unit 14 that fixes the ink absorbing particles 100 transferred to the recording medium 200 on the recording medium 200.

The ink absorbing particles 100 absorb ink component when an ink is brought into contact with the ink absorbing particles 100. Here, "ink absorbing" indicates the retention of at least a part of the ink component (at least a liquid component). A thermoplastic resin is used for the ink absorbing particles and a thermoplastic resin having a softening point of equal to or below 150° C. can be suitably used. A higher softening point results in poor image fixing and easy bleeding due to high humidity holding capability of resins.

The average equivalent spherical diameter of the ink absorbing particles as a whole may be in the range of 0.5 to 50 μm (or 1 μm to 30 μm, or 3 μm to 20 μm, or 5 μm to 10 μm).

The average equivalent spherical diameter is determined as follows. The optimum method depends on particle size; however, for example, a method in which the particle diameter is determined by applying the principle of light scattering to a dispersion of the particles in a liquid, or a method in which the particle diameter is determined by image processing of a projected image of the particles, or other methods may be utilized. Examples of methods generally used include a Microtrack UPA method or a Coulter counter method.

Specific examples of the thermoplastic resin may include: polyacrylic acid and the salt thereof; polymethacrylic acid and the salt thereof; a copolymer of (meth)acrylic acid ester, and (meth)acrylic acid and the salt thereof; a copolymer of styrene, and (meth)acrylic acid and the salt thereof; a copolymer of styrene, (meth)acrylic acid ester, and (meth)acrylic acid and the salt thereof; a copolymer of styrene, (meth) acrylic acid ester, and an ester that is formed from an alcohol having an aliphatic or aromatic substitution group having a carboxylic acid and the salt structure thereof and (meth) acrylic acid; a copolymer of (meth)acrylic acid ester and an ester that is formed from an alcohol having an aliphatic or aromatic substitution group having a carboxylic acid and the salt structure thereof and (meth)acrylic acid; a copolymer of ethylene and (meth)acrylic acid; a copolymer of butadiene, (meth)acrylic acid ester, and (meth)acrylic acid and the salt thereof; a copolymer of butadiene, (meth)acrylic acid ester, and an ester that is formed from an alcohol having an aliphatic or aromatic substitution group having carboxylic acid and the salt structure thereof and (meth)acrylic acid; polymaleic acid and the salt thereof; a copolymer of styrene, and maleic acid and the salt thereof; the foregoing resins modified with sulfonic acid; and the foregoing resins modified with phosphoric acid. More specifically, examples may include polyacrylic acid and the salt thereof; a copolymer of styrene, and (meth) acrylic acid and the salt thereof; a copolymer of styrene, (meth)acrylic acid ester, and (meth)acrylic acid and the salt thereof; a copolymer of styrene, (meth)acrylic acid ester, and an ester that is formed from an alcohol having an aliphatic or aromatic substitution group having a carboxylic acid and the salt structure thereof and (meth)acrylic acid; and a copolymer of (meth)acrylic acid ester, and (meth)acrylic acid and the salt thereof. These resins may be crosslinked or non-crosslinked. A softening point can be controlled by a selection of monomers and a degree of polymerization. The softening point of the ink absorbing particles used in the present exemplary embodiment is measured by TMA (Thermo Mechanical Analysis). A softening point of from equal to or below 130° C. to equal to or above 40° C., or preferably, from equal to or below 120° C. to equal to or above 50° C. may be used for easy fixation.

The belt 10 is an example of the intermediate transfer member described in the Summary. In the first exemplary embodiment, the belt 10 has a base layer made of a conductive polyimide film and a surface layer made of a tetrafluoroethylene-perfluoroalkylvinylether copolymer (PFA resin) formed on the base layer. However, the belt 10 is not limited to this formation and may be formed of other rubber materials such as nitrile rubber, ethylene propylene rubber, chloroprene rubber, isoprene rubber, styrene rubber, butadiene rubber, butyl rubber, chlorosulfonated polyethylene, urethane rubber, epichlorohydrin rubber, acryl rubber, silicone rubber, fluoro rubber, or resin materials such as polyamide-imide, polyester, polyurethane, polyamide, polyether sulfone, fluoro resin, polyethylene terephthalate (PET). The ink absorbing particles 100 are supplied on the belt 10 by the ink absorbing particle supplying unit 11 and the plural ink absorbing particles 100 are arranged on the intermediate transfer member. In the present exemplary embodiment, an example of using a developing unit used in electrophotographic system for the ink absorbing particle supplying unit 11 is shown. In a tank 113 provided for the developer, the ink absorbing particles 100 instead of toner and magnetic members 101 that hold electrostatically the ink absorbing particles 100 are stocked. In this example, a situation is shown, in which a tank 111 that stores unused ink absorbing particles 100 and a tank 112 that stores ink absorbing particles 100*a* to be recycled are connected to the tank 113 included in the developer such that the unused ink absorbing particles 100 and the ink absorbing particles 100*a* to be recycled are mixed for use.

The ink absorbing particles 100 that are electrostatically held to the magnetic members 101 are guided along with the magnetic members 101 in the tank 111 to the belt 10 to be supplied thereon, with the rotation of a cylindrical-shaped sleeve 102 that covers multiple magnets in the tank 113 included in the developer, in a manner similar to developing in the electrophotographic process.

In this way, the ink absorbing particles 100 supplied and arranged on the belt 10 by the ink absorbing particle supplying unit 11 are carried to the inkjet recording head 12 with the rotation of the belt 10.

Then, onto the ink absorbing particles 100 arranged, ink is ejected through a nozzle of the inkjet recording head 12, thereby a color image is formed on a group of the ink absorbing particles arranged on the belt 10. For the inkjet recording head 12, four heads of 12K, 12C, 12M, and 12Y that can eject black, cyan, magenta, and yellow colored inks respectively are arranged along a rotating direction indicated by the arrow of the belt 10. A certain amount of ink in accordance with image data is ejected from each head onto each of the ink absorbing particles 100 on the belt with the rotation of the belt 10.

(Ink)

Hereinafter, details of the ink will be described. The ink includes a recording material, an organic solvent, and water, and may optionally include other additives. The organic solvent included in the ink is selected to have a SP value such that the absolute value of a difference between a SP value of the organic solvent included in the ink and a SP value of the monomer components included in the hydrophilic resin, other than the monomer component having a dissociable group, is within the above described range. The organic solvent included in the ink may be selected to have a SP value such that the absolute value of a difference between the SP value of the organic solvent included in the ink and a SP value of the monomer component having a hydroxyl group included in the hydrophilic resin is within the above-described range.

Details of the recording material will now be explained. A colorant may be used as the recording material, which may be either a dye or a pigment, but may be a pigment. Either an organic pigment or an inorganic pigment may be used as the pigment. Examples of the black pigments include carbon black pigments such as furnace black, lamp black, acetylene black, and channel black. In addition to black and three primary colors of cyan, magenta and yellow, other pigments of specific colors such as red, green, blue, brown or white, metal glossy pigments of gold, silver or the like, body pigments of colorless or pale color, plastic pigments, or the like. A pigment newly synthesized for the invention may also be used.

Further, particles composed of a core of silica, alumina, polymer bead or the like on which a dye or a pigment is fixed, an insoluble lake compound of a dye, a colored emulsion, a colored latex or the like may also be used as a pigment.

Specific examples of the black pigments used in the present invention include RAVEN 7000, RAVEN 5750, RAVEN 5250, RAVEN 5000 ULTRA II, RAVEN 3500, RAVEN 2000, RAVEN 1500, RAVEN 1250, RAVEN 1200, RAVEN 1190 ULTRA II, RAVEN 1170, RAVEN 1255, RAVEN 1080 and RAVEN 1060 (manufactured by Columbian Chemicals Company); REGAL 400R, REGAL 330R, REGAL 660R, MOGUL L, Black Pearls L, MONARCH 700, MONARCH 800, MONARCH 880, MONARCH 900, MONARCH 1000, MONARCH 1100, MONARCH 1300 and MONARCH 1400 (manufactured by Cabot Corporation); Color Black FW1, Color Black FW2, Color Black FW2V, Color Black 18, Color Black FW200, Color Black S150, Color Black S160, Color Black S170, PRINTEX 35, PRINTEX U, PRINTEX V, PRINTEX 140U, PRINTEX 140V, Special Black 6, Special Black 5, Special Black 4A and Special Black 4 (manufactured by Degussa Co.); and No. 25, No. 33, No. 40, No. 47, No. 52, No. 900, No. 2300, MCF-88, MA 600, MA 7, MA 8 and MA 100 (manufactured by Mitsubishi Chemical Co., Ltd.). However, the pigments are not restricted thereto.

Specific examples of the cyan color pigments include C.I. Pigment Blue-1, -2, -3, -15, -15:1, -15:2, -15:3, -15:4, -16, -22 and -60, but are not restricted thereto.

Specific examples of the magenta color pigments include C.I. Pigment Red-5, -7, -12, -48, -48:1, -57, -112, -122, -123, -146, -168, -177, -184, -202, and C.I. Pigment Violet -19, but are not restricted thereto.

Specific examples of the yellow color pigments include C.I. Pigment Yellow-1, -2, -3, -12, -13, -14, -16, -17, -73, -74, -75, -83, -93, -95, -97, -98, -114, 128, -129, -138, -151, -154 and -180, but are not restricted thereto.

Here, in the case where a pigment is used as the colorant, a pigment dispersing agent may be used in combination. Examples of usable pigment dispersing agents include a polymer dispersing agent, an anionic surfactant, a cationic surfactant, an amphoteric surfactant and a nonionic surfactant.

As the polymer dispersing agent, a polymer having both of a hydrophilic structure part and a hydrophobic structure part may be used. As the polymer having a hydrophilic structure part and a hydrophobic structure part, a condensation-type polymer and an addition polymer may be used. Examples of the condensation-type polymers include known polyester-based dispersing agents. Examples of the addition polymers include addition polymers of monomers having an α,β-ethylenically unsaturated group. By copolymerizing a monomer having an α,β-ethylenically unsaturated group and a hydrophilic group and a monomer having an α,β-ethylenically unsaturated group and a hydrophobic group, a desired polymer dispersing agent may be obtained. Further, a homopolymer of monomers having an α,β-ethylenically unsaturated group and a hydrophilic group may also be used.

Examples of the monomers having an α,β-ethylenically unsaturated group and a hydrophilic group include monomers having a carboxyl group, a sulfonic acid group, a hydroxyl group, a phosphoric acid group or the like; specifically, acrylic acid, methacrylic acid, crotonic acid, itaconic acid, itaconic acid monoester, maleic acid, maleic acid monoester, fumaric acid, fumaric acid monoester, vinyl sulfonic acid, styrene sulfonic acid, sulfonated vinyl naphthalene, vinyl alcohol, acrylamide, methacryloxy ethyl phosphate, bis (methacryloxy ethyl) phosphate, methacryloxy ethyl phenyl acid phosphate, ethylene glycol dimethacrylate, diethylene glycol dimethacrylate and the like.

Examples of the monomer having an α,β-ethylenically unsaturated group and a hydrophobic group include styrene derivatives such as styrene, α-methylstyrene and vinyl toluene, vinyl cyclohexane, vinyl naphthalene, vinyl naphthalene derivatives, alkyl acrylate, alkyl methacrylate, phenyl methacrylate, cycloalkyl methacrylate, alkyl crotonate, dialkyl itaconate, dialkyl maleate and the like.

Specific examples of the copolymers used as a polymer dispersant include a styrene-styrene sulfonic acid copolymer, a styrene-maleic acid copolymer, a styrene-methacrylic acid copolymer, a styrene-acrylic acid copolymer, a vinylnaphthalene-maleic acid copolymer, a vinylnaphthalene-methacrylic acid copolymer, a vinylnaphthalene-acrylic acid copolymer, an alkyl acrylate-acrylic acid copolymer, an alkyl methacrylate-methacrylic acid copolymer, a styrene-alkyl methacrylate-methacrylic acid copolymer, a styrene-alkyl acrylate-acrylic acid copolymer, a styrene-phenyl methacrylate-methacrylic acid copolymer, and a styrene-cyclohexyl methacrylate-methacrylic acid copolymer. A monomer having a polyoxyethylene group or a hydroxyl group may also be copolymerized with the above polymers.

From a viewpoint of suppressing inhibition of liquid absorbing of the ink absorbing particles, the above-mentioned polymer dispersing agent may have a relatively small molecular weight such as a weight average molecular weight of from 1,000 to 250,000.

These pigment dispersing agents may be used alone or in combination of two or more kinds. Although the addition amount of the pigment dispersing agent varies largely depending on the types of the pigments, the addition amount thereof is generally in the range of from 0.1% by weight to 100% by weight with respect to the amount of the pigment.

A pigment capable of self-dispersing in water may also be used as a colorant. A pigment capable of self-dispersing in water may suppress inhibition of liquid absorbing of the ink absorbing particles. The pigment capable of self-dispersing in water used in the present invention refers to the pigment that has a large number of water-solubilizing groups on the surface of the pigment and is capable of dispersing in water without the presence of a polymer dispersant. The pigment capable of self-dispersing in water may be obtained by subjecting a common so-called pigment to surface modification treatments such as an acid or a base treatment, a coupling agent treatment, a polymer graft treatment, a plasma treatment or a redox treatment.

In addition to the above surface-modified pigments, commercially available pigments such as CAB-O-JET-200, CAB-O-JET-300, CAB-O-JET-250, CAB-O-JET-260, CAB-O-JET-270, IJX-444 and IJX-55 (manufactured by Cabot Corporation), and MICROJET BLACK CW-1 and CW-2 (manufactured by Orient Chemical Industries, Ltd.) may also be used as a pigment capable of self-dispersing in water.

The above self-dispersing pigments may be a pigment having at least a functional group of sulfonic acid, a sulfonate, a carboxylic acid, or a carboxylate on the surface thereof, or a pigment having a functional group of at least a carboxylic acid or a carboxylate on the surface thereof.

A pigment coated with a resin may also be used as the colorant. Such a pigment is called as a microcapsule pigment, which include commercially available microcapsule pigments manufactured by Dainippon Ink & Chemicals, Inc. and Toyo Ink MFG Co., Ltd. as well as the microcapsule pigments prepared for use in the invention.

A resin dispersing-type pigment composed of the above pigment to which a polymer substance is adsorbed or chemically bonded may also be used.

Other examples of the recording materials include dyes such as a hydrophilic anionic dye, direct dye, cationic dye, reactive dye, high molecular dye and oil-soluble dye, wax powder, resin powder or emulsions colored with a dye, fluorescent dye or fluorescent pigment, infrared absorber, ultraviolet absorber, magnetic materials such as ferromagnetic materials represented by ferrite, magnetite and others, semiconductors and photo catalysts represented by titanium oxide, zinc oxide and others, and other organic and inorganic particles of an electronic material.

The content (concentration) of the recording material is, for example, from 1% by weight to 20% by weight (or from 1% by weight to 15% by weight, or from 3% by weight to 10% by weight) with respect to the amount of the ink.

The volume average particle diameter of the colorant is, for example, from 10 nm to 300 nm.

The volume average particle diameter of the recording material refers to the particle diameter of the recording material itself, or when an additive such as a dispersing agent is attached to the recording material, the particle diameter including the attached additive. In the invention, as the device for measurement of the volume average particle diameter, MICROTRUC UPA particle size analysis meter 9340 (produced by Leeds & Northrup Corp.) is used. The measurement is carried out according to the predetermined method with 4 ml of an ink put into a measuring cell. As the parameters to input for the measurement, the viscosity of the ink and the density of the recording material are used as the viscosity and the density of dispersed particles, respectively.

Next, an organic solvent will be mentioned. As an organic solvent, water soluble organic solvents such as polyhydric alcohols, polyhydric alcohol derivatives, nitrogen-containing solvents, alcohols, sulfur-containing solvents, and the like may be used.

Specific examples of the polyhydric alcohols include ethylene glycol, diethylene glycol, propylene glycol, butylene glycol, triethylene glycol, 1,5-pentane diol, 1,2-hexane diol, 1,2,6-hexane triol, glycerin, trimethylolpropane and sugar alcohols such as xylitol; and saccharides such as xylose, glucose and galactose.

Specific examples of the polyhydric alcohol derivatives include ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, and the ethylene oxide adduct of diglycerol.

Specific examples of the nitrogen-containing solvents include pyrrolidone, N-methyl-2-pyrrolidone, cyclohexyl pyrrolidone, and triethanol amine. Specific examples of the alcohols include ethanol, isopropyl alcohol, butyl alcohol and benzyl alcohol. Specific examples of the sulfur-containing solvents include thiodiethanol, thiodiglycerol, sulfolane, and dimethyl sulfoxide.

Propylene carbonates, ethylene carbonates, or the like may also be used as the water-soluble organic solvent.

The water-soluble organic solvent may be used as one or more kinds thereof. The content of the water-soluble organic solvent to be used is, for example, from 1% by weight to 70% by weight.

Next, water will be explained. As the water, ion exchange water, ultra pure water, distilled water or ultrafiltrated water may be used in order to prevent introduction of impurities.

Next, other additives will be explained. A surfactant may be added to the ink.

As the surfactants, various kinds of anionic surfactants, nonionic surfactants, cationic surfactants, amphoteric surfactants and the like may be used, and the anionic surfactants and the nonionic surfactants may be used.

Specific examples of the anionic surfactants include an alkylbenzenesulfonate, alkylphenylsulfonate, alkylnaphthalenesulfonate, higher fatty acid salt, sulfuric acid ester salt of higher fatty acid ester, sulfonic acid salt of higher fatty acid ester, sulfuric acid ester salt and sulfonic acid salt of higher alcohol ether, higher alkylsulfosuccinate, polyoxyethylene alkyl ethercarboxylate, polyoxyethylene alkyl ethersulfate, alkylphosphate and polyoxyethylene alkyl etherphosphate, and dodecylbenzenesulfonate, isopropylnaphthalenesulfonate, monobutylphenylphenol monosulfonate, monobutylbiphenylsulfonate, monobutylbiphenylsulfonate and dibutylphenylphenoldisulfonate may be used.

Specific examples of the nonionic surfactants include polyoxyethylene alkyl ether, polyoxyethylene alkylphenyl ether, polyoxyethylene fatty acid ester, sorbitan fatty acid ester, polyoxyethylene sorbitan fatty acid ester, polyoxyethylene sorbitol fatty acid ester, glycerol fatty acid ester, polyoxyethyleneglycerol fatty acid ester, polyglycerol fatty acid ester, sucrose fatty acid ester, polyoxyethylene alkylamine, polyoxyethylene fatty acid amide, alkylalkanol amide, polyethyleneglycol polypropyleneglycol block copolymer, acetylene glycol and polyoxyethylene adduct of acetylene glycol, and polyoxyethylene nonyl phenyl ether, polyoxyethylene octyl phenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester, fatty acid alkylol amide, polyethyleneglycol polypropyleneglycol block copolymer, acetylene glycol and polyoxyethylene adduct of acetylene glycol may be used.

In addition, silicone surfactants such as polysiloxane oxyethylene adducts, fluorine surfactants such as perfluoroalkyl carboxylate, perfluoroalkyl sulfonate and oxyethylene perfluoroalkyl ether, and biosurfactants such as spiculisporic acids, rhamnolipid and lysolecithin.

These surfactants may be used alone or in combination. The hydrophilicity/hydrophobicity balance (HLB) of the surfactant may be in the range of 3 to 20 in view of dissolvability or the like.

The amount of the surfactant to be added may be from 0.001% by weight to 5% by weight, or from 0.01% by weight to 3% by weight.

Further, other various additives may be added to the ink, such as a permeating agent for adjusting permeating property of the ink, compounds such as polyethylene imine, polyamines, polyvinyl pyrrolidone, polyethylene glycol, ethyl cellulose and carboxy methyl cellulose, for controlling ink ejection property, and alkali metal compounds such as potassium hydroxide, sodium hydroxide and lithium hydroxide for adjusting conductivity and pH of the ink. As needed, a pH buffer, an antioxidant, a mildew preventing agent, a viscosity adjusting agent, a conductive agent, an ultraviolet ray absorbing agent, a chelating agent or the like may also be added.

Next, the properties of the ink will be explained. First, the pH of the ink is, for example, may be not less than 7, or in the range of from 7 to 11, or in the range of from 8 to 10.

Here, the value of the pH of the ink as measured under ambient conditions of temperature of 23±0.5° C. and humidity of 55±5% R.H., using a pH/conductivity meter (MPC 227; manufactured by Mettler-Toledo International Inc.), is adopted.

The surface tension of the ink is, for example, 20 to 40 mN/m (or from 25 to 35 mN/m).

Here, the value as the surface tension is measured under the conditions of 23° C. and 55% RH by the use of a Willhermy type surface tensiometer (produced by Kyowa Interface Science Co., Ltd.) is used.

The ink viscosity may be, for example, from 2 mPa·s to 20 mPa·s (or from 3 mPa·s to 15 mPa·s, or about 10 mPa·s).

The viscosity here is determined as a value measured by using RHEOMAT 115 (manufactured by Contraves), at a measuring temperature of 23° C. and a shearing speed of 1400 $s^{-1}$.

The ink is not particularly limited to the above composition, and may include other functional materials than the recording material, such as a liquid crystal material or an electronic material.

After the color image is formed on the ink absorbing particles arranged on the belt 10, the ink absorbing particles on which the color image is formed is carried to the image transfer unit 13 with the rotation of the belt 10. In the image transfer unit 13, the image is transferred to a recording medium 200 by gripping the ink absorbing particles 100 and the recording medium 200 together with a strength given by a transfer roller 13A and a holding roller 13B that holds the belt 10. The present exemplary embodiment shows a configuration example in which a viscous property of the ink absorbing particles 100 that become viscous with the ejected ink is used and image transfer is achieved by gripping the ink absorbing particles with the transfer roller 13A and the holding roller 13B, without applying heat.

After the color image formed on the ink absorbing particles is transferred to the recording medium 200, both pressure and heat are applied to the ink absorbing particles on the recording medium 200 by the fixing unit 14 to fuse the ink absorbing particles on the recording medium 200. Additionally, as illustrated in FIG. 1, recording media 200 are piled on in a sheet-supplying unit 201 and ejected to a sheet-ejecting unit 202 after images are formed on each of them.

With the configuration in FIG. 1, it is possible to reduce curling and waving in a recording medium having a large humidity absorbing property and to reduce bleeding in a recording medium having a small humidity absorbing property, compared to a case where an image is formed by directly ejecting ink onto a recording medium.

Here, a particle collecting unit 15 that collects the ink absorbing particles 100*a* remaining on the belt 10 is provided on a downstream side from the image transfer unit 13 along the rotating direction of the belt 10. The particle collecting unit 15 collects the ink absorbing particles 100*a* in a non-image area illustrated in FIG. 2, which are left on the belt 10 without being transferred by the image transfer unit 13. Since the ink absorbing particles 100*a* collected by the particle collecting unit 15 have absorbed humidity in the air to cause relative humidity around the ink absorbing particles 100*a* to rise, the relative humidity around the ink absorbing particles 100*a* is subjected to relative humidity reduction by a humidity reducing unit 16. The ink absorbing particles 100*a* of reduced humidity are passed to the ink absorbing particle supplying unit 11 by being supplied to the tank 113 via the tank 112.

Figure 2:
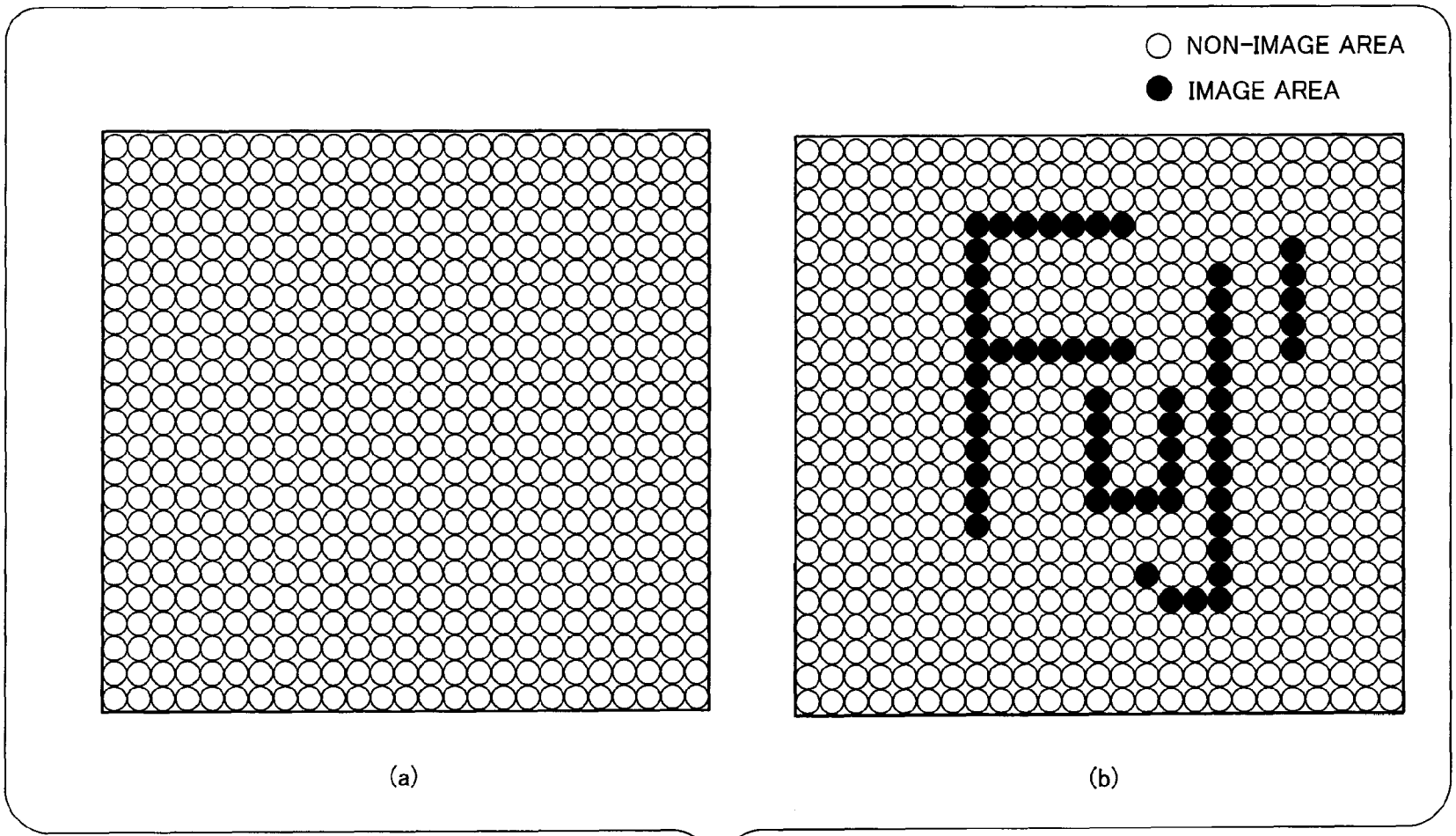
FIG. 2A is a diagram showing a state of ink absorbing particles 100 supplied on a belt 10 having no ends.
FIG. 2B is a diagram showing an image formed on the ink absorbing particles 100.

The ink absorbing particles 100*a* are mixed with new unused ink absorbing particles 100 in the tank 111 and then supplied on the belt 10 by the ink absorbing particle supplying unit 11. In this way, the ink absorbing particles 100*a* in the non-image area in FIG. 2 are recycled.

Additionally, at the time of recycling the ink absorbing particles 100*a* in the non-image area, the amount of the ink absorbing particles 100*a* used for recycling after the relative humidity reduction is controlled to occupy 30% or below of the whole amount. Especially, if the amount of the ink absorbing particles 100*a* used for recycling is controlled to occupy 20% or below of the whole amount, bleeding of images becomes almost indistinguishable and high-quality images can be obtained. Therefore, in the above exemplary embodiment, the amount of the ink absorbing particles 100*a* used for recycling is controlled to occupy 20% or below of the total amount.

Figure 3:
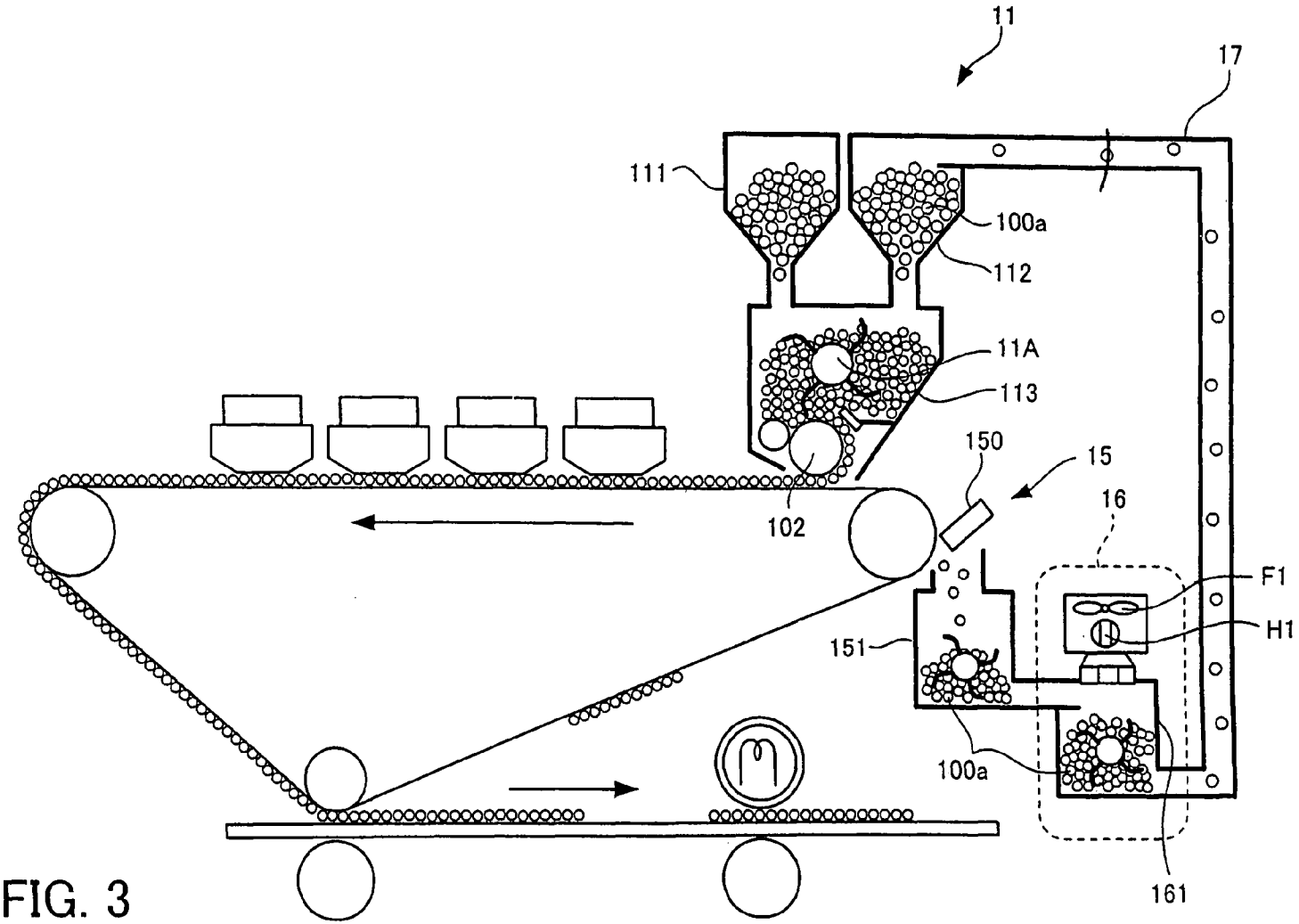
FIG. 3 is a diagram showing a specific configuration example of a particle collecting unit 15 and a humidity reducing unit 16 in FIG. 1.

FIG. 3 is a diagram showing a specific configuration example of the particle collecting unit 15 and the humidity reducing unit 16 in FIG. 1.

The particle collecting unit 15 in FIG. 3 includes a scraping member 150 for scraping the ink absorbing particles 100 on the belt 10 and a particle collect chamber 151 for temporarily storing ink absorbing particles 100*a* recovered from the belt 10. The particle collecting unit 15 can send out the ink absorbing particles 100*a* without overflowing the ink absorbing particles 100*a* from the humidity reducing unit 16 that is provided at a later step, even if a large amount of the ink absorbing particles 100*a* is collected in a short span of time. The humidity reducing unit 16 absorbs the ink absorbing particles 100*a* from the particle collect chamber 151 and sends the particles to a particle dry chamber 161 for drying the particles. The scraping member 150 is a board member formed of an elastic material such as polyurethane.

The humidity reducing unit 16 includes a heater H1 and a fan F1 above the particle dry chamber 161 and dries the ink absorbing particles 100*a* by blowing hot air heated by the heater H1 into the particle dry chamber 161 and reduces relative humidity around the ink absorbing particles. Agitators are provided for the particle collect chamber 151 and the particle dry chamber 161 in FIG. 3, and with the agitators, plural ink absorbing particles 100*a* in the chambers are stirred so that each of the plural ink absorbing particles 100*a* can be dried uniformly.

Incidentally, the agitator can be one having a rotating axis with multiple board-shaped feathers attached around the axis or one with helical structured feathers. The agitator is not limited to these configurations and can take a different shape as long as it can stir the ink absorbing particles 100*a*.

The ink absorbing particles 100 in the present exemplary embodiment are particles made of a thermoplastic resin as described above, and the humidity reducing unit 16 reduces relative humidity around the ink absorbing particles 100*a* by drying the particles 100*a* collected by the particle collecting unit 15 with the application of heating that heats up the particles 100*a* at a temperature below a softening point thereof, for the purpose of making a state of the collected ink absorbing particles 100*a* close to that of the unused ink absorbing particles 100. With this configuration, it is possible to favorably use a thermoplastic resin having a softening point of equal to or below 150° C. as ink absorbing particles, as described above. Using thermoplastic resins with a higher softening point than this results in poor image fixing and easy bleeding due to high humidity holding capability of resins. It also makes it difficult for the humidity reducing unit 16 in the present exemplary embodiment to reduce relative humidity around the ink absorbing particles 100*a* collected by the particle collecting unit 15.

Further, a carry path 17 is provided on the way from the particle dry chamber 161 to the ink absorbing particle supplying unit 11, and the ink absorbing particles 100*a* used for recycling are passed to the ink absorbing particle supplying unit 11 through the carry path 17. For this reason, an agitator 11A is disposed in the ink absorbing particle supplying unit 11 for the purpose of stirring the ink absorbing particles 100*a* used for recycling that are carried via the carry path 17 and the unused ink absorbing particles 100 together so that both particles are mixed by the time of being supplied on the belt 10. In this example, the ratio of the ink absorbing particles 100*a* for recycling is controlled to occupy 20% or below of the total amount, by adjusting a carrying speed at which the particles 100*a* are carried from the tank 112 to the ink absorbing particle supplying unit 11.

Figure 4:
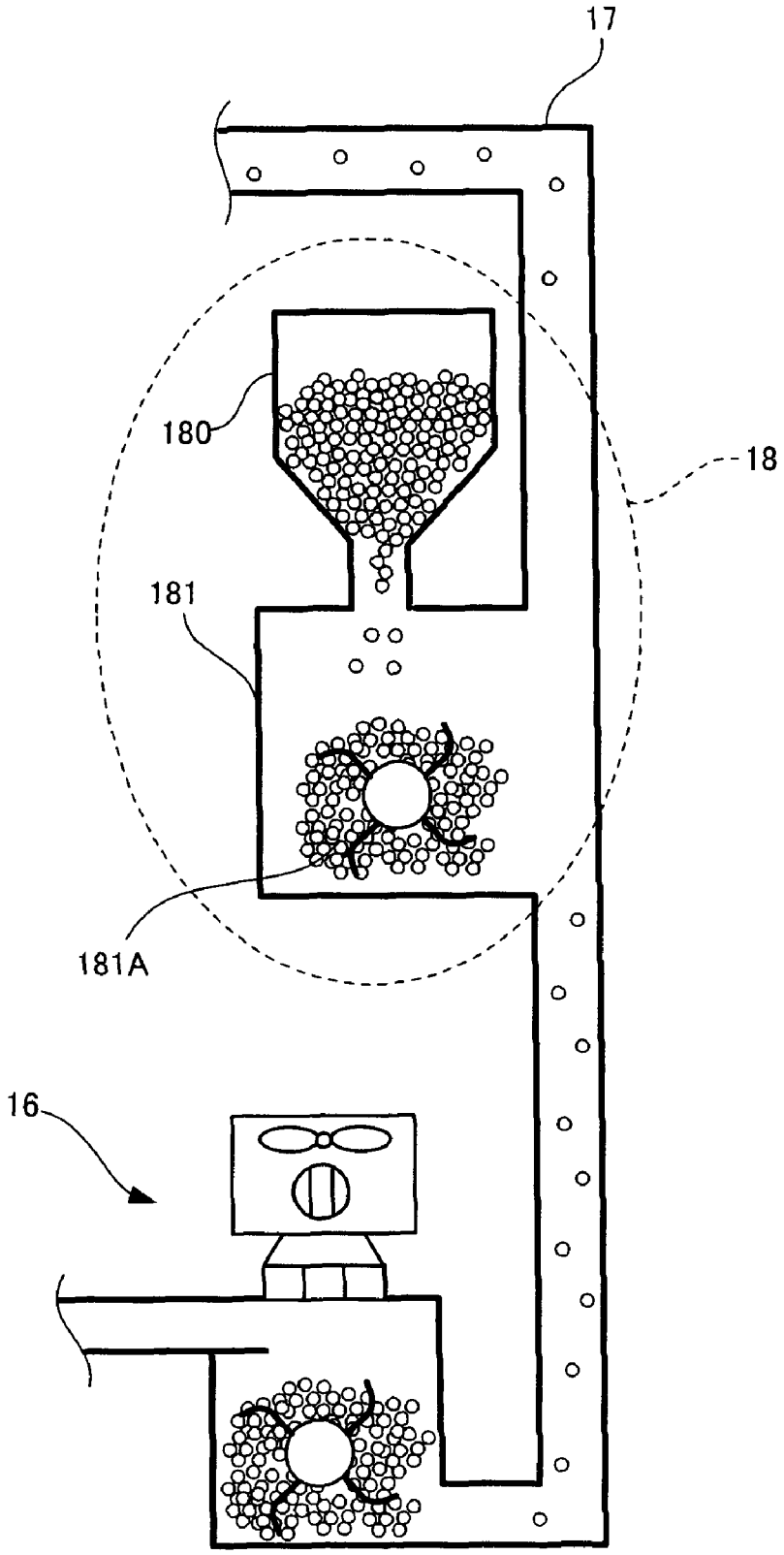
FIG. 4 is a diagram showing an example of an external additive adding unit 18 provided in the middle of a carry path 17.

FIG. 4 is a diagram showing an example of an external additive adding unit 18 provided in the middle of the carry path 17.

On the surface of the unused ink absorbing particles 100 stocked in the tank 111 shown in FIGS. 1 and 3, an external additive is supplied for adding fluidity of fine particles, electrical charging, and conductivity control or the like. However, there are cases in which working of the external additive may be lowered or the external additive may be peeled off from the surface of the ink absorbing particles in the process of being supplied on the belt 10, carried with the rotation of the belt 10, and subjected to the humidity reducing processing.

Therefore, in FIG. 4, an external additive adding unit 18 is provided in the middle of the carry path 17 that carries the ink absorbing particles 100*a* subjected to the reduction in relative humidity by the humidity reducing unit 16, to the ink absorbing particle supplying unit 11. This external additive adding unit 18 includes a tank 180 in which an external additive is stored and an external additive adding chamber 181. In the external additive adding chamber 181, an agitator 181A is provided to prevent the external additive from leaning to one side. As examples of external additives, inorganic fine particles of colorless, dim-colored or white particles, for example, such as colloidal silica, alumina, calcium carbonate, zinc oxide, titanium oxide, tin oxide, cerium oxide and others, or fine resin particles such as vinyl resin, polyester, and silicone can be considered. The particle diameter of the external additive is, for example, 10 nm to 1 μm, or 10 nm to 0.1 μm, or 10 nm to 0.05 μm in average equivalent spherical diameter.

In this way, with the configuration in which the external additive adding unit 18 is provided to supply an external additive onto the ink absorbing particles 100*a* used for recycling, a state of the ink absorbing particles 100*a* for recycling becomes close to a state of the unused ink absorbing particles 100.

As described above, a series of steps corresponds to an example of the image forming method according to the invention, the steps in which the ink absorbing particles 100 are supplied on the intermediate transfer member 10; ink is ejected from the inkjet recording head 12 onto the supplied ink absorbing particles 100 to make the particles 100 absorb the ink; the ink absorbing particles 100 having absorbed the ink are transferred to the recording medium 200 to be fixed; the ink absorbing particles 100*a* remaining on the intermediate transfer member 10 after the transferring is made is collected by the particle collecting unit 15; the ink absorbing particles 100*a* are returned to the ink absorbing particle supplying unit 11 after relative temperature around the ink absorbing particles 100*a* are lowered by the humidity reducing unit 16; the collected ink absorbing particles 100*a* recovered by the particle collecting unit 15 is reused for the steps of forming a next image.

Figure 5:
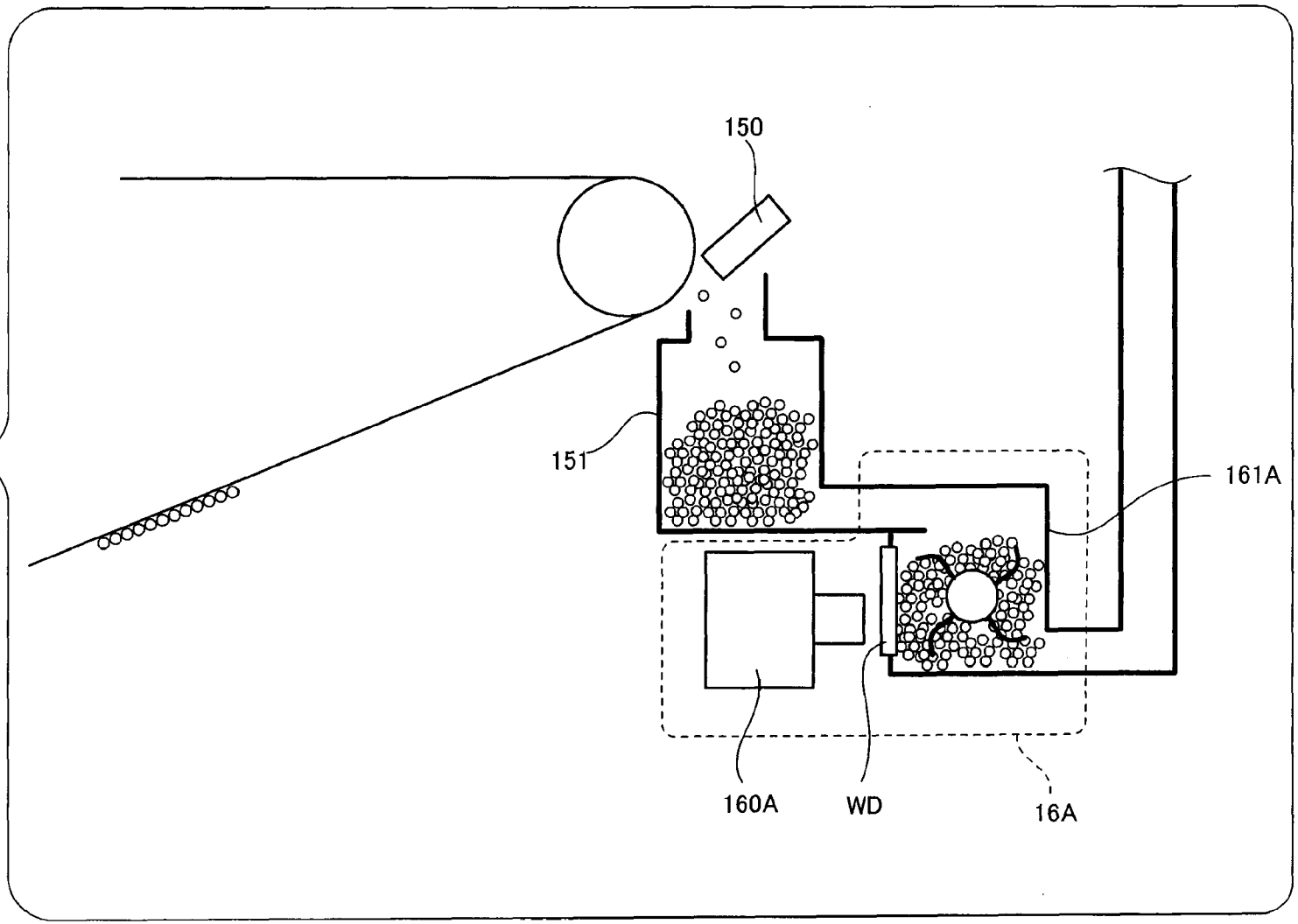
FIG. 5 is a diagram showing a humidity reducing unit 16A whose configuration is different from that of the humidity reducing unit 16 in FIG. 1.

FIG. 5 is a diagram showing a humidity reducing unit 16A whose configuration is different from that of the humidity reducing unit 16 in FIG. 1.

In FIG. 5, an example is illustrated, in which a microwave heating unit 160A is provided instead of the heater H1 and the fan F1 as a heating source included in the humidity reducing unit 16A in FIG. 3. It is also possible to have a configuration in which a glass window WD is provided in the particle dry chamber 161A for letting microwaves pass through and microwaves from the microwave heating unit 160A are sent into the particle dry chamber 161A through the glass window WD to dry the ink absorbing particles 100*a* so that relative humidity around the ink absorbing particles 100*a* is reduced. The humidity reducing unit 16A in the present exemplary embodiment can reduce relative humidity around the ink absorbing particles 100*a* by heating the ink absorbing particles collected by the particle collecting unit 15 at a temperature below a softening point of the ink absorbing particle 100.

Figure 6:
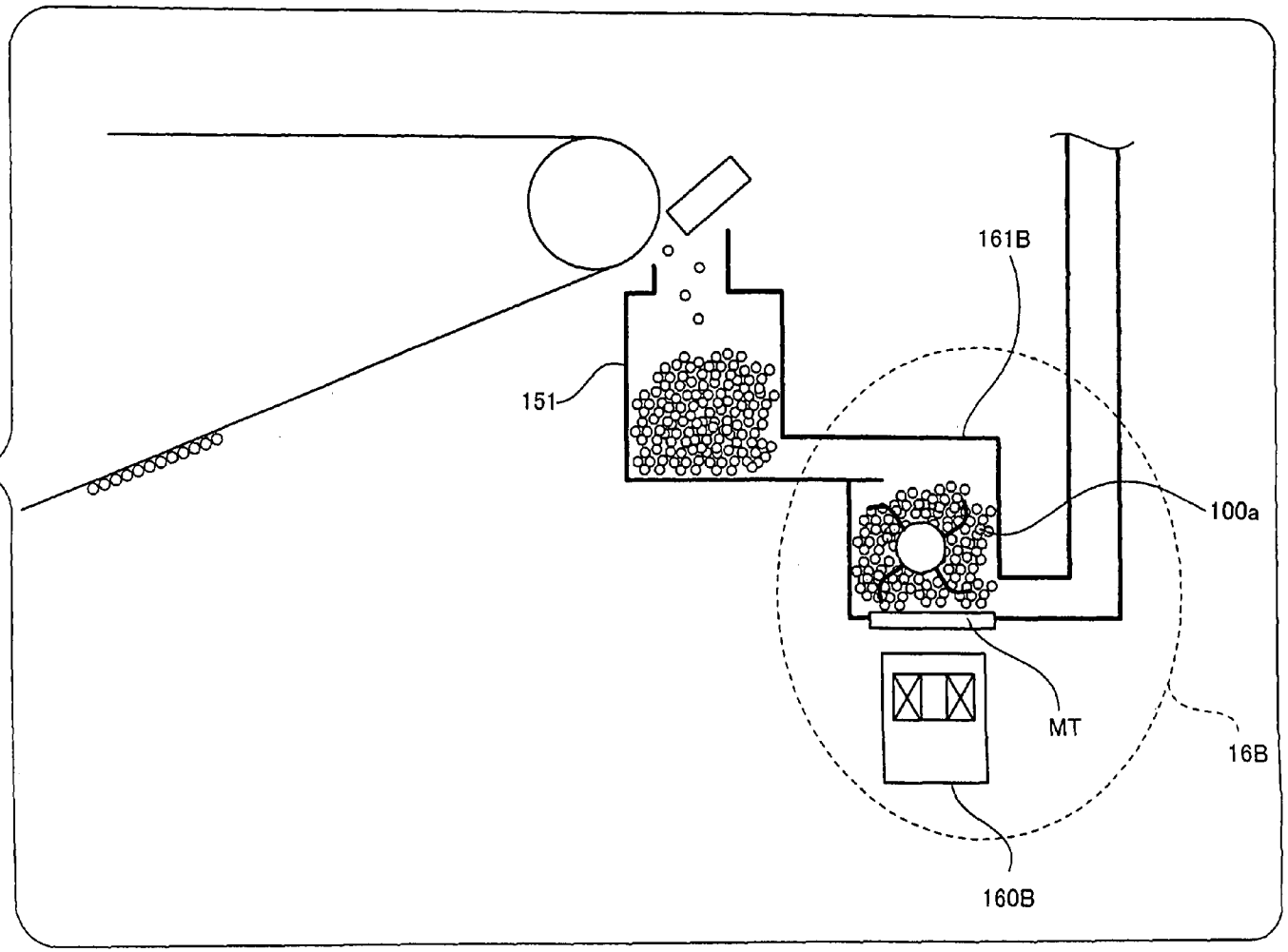
FIG. 6 is a diagram showing a humidity reducing unit 16B whose configuration is different from those of the humidity reducing unit 16 in FIG. 1 and the humidity reducing unit 16A in FIG. 5.

FIG. 6 is a diagram showing a humidity reducing unit 16B whose configuration is different from those of the humidity reducing unit 16 in FIG. 1 and the humidity reducing unit 16A in FIG. 5.

An induction heating unit 160B may be used as illustrated in FIG. 6 instead of the microwave heating unit 160A in FIG. 5. When using this induction heating unit 160B, a bottom of the particle dry chamber 161B is formed of a metal plate MT and heating is applied through the metal plate MT. As described above, the humidity reducing unit 16B in the present exemplary embodiment can reduce relative humidity around the ink absorbing particles by heating the recovered ink absorbing particles 100*a* collected by the particle collecting unit 15 at a temperature below the softening temperature of the ink absorbing particle 100.

Figure 7:
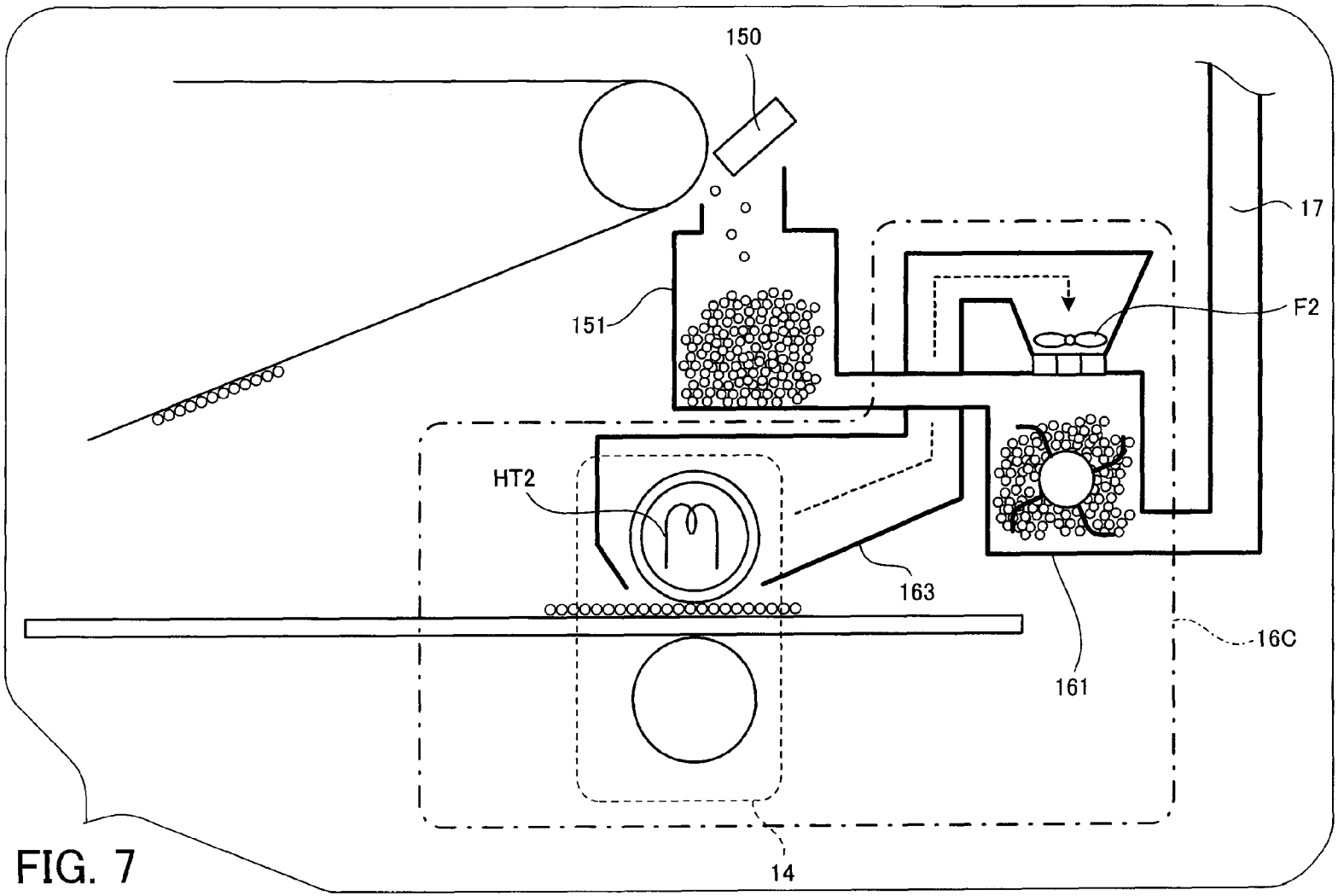
FIG. 7 is a diagram showing a humidity reducing unit 16C whose configuration is different from those of the humidity reducing unit 16 in FIG. 1, the humidity reducing unit 16A in FIG. 5, and the humidity reducing unit 16B in FIG. 6.

FIG. 7 is a diagram showing a humidity reducing unit 16C whose configuration is different from those of the humidity reducing unit 16 in FIG. 1, the humidity reducing unit 16A in FIG. 5, and the humidity reducing unit 16B in FIG. 6.

The humidity reducing unit 16C in FIG. 7 lowers relative humidity around the ink absorbing particles 100*a* recovered by the particle collecting unit 15 by heating with heat guided from the fixing unit 14.

As illustrated in FIG. 1 and FIG. 3, since the fixing unit 14 includes a heater HT2, it is possible to have a configuration in which relative humidity around the ink absorbing particles 100*a* is reduced by guiding air heated by the heater HT2 via a heat conductive path 163 so that the heated air is ejected onto the ink absorbing particles 100*a* in the particle dry chamber 161 with a fan F2 to dry the ink absorbing particles 100*a*.

As described above, the humidity reducing unit 16C in the present exemplary embodiment can reduce relative humidity around the ink absorbing particles by heating the recovered ink absorbing particles 100*a* collected by the particle collecting unit 15 at a temperature below the softening temperature of the ink absorbing particle 100, that is, equal to or below 150° C.

Incidentally, the configuration in FIG. 7 may be further simplified such that the particle collect chamber 151 is disposed above a case that houses the heater included in the fixing unit 14 and the heat of the heater included in the fixing unit 14 is used to lower the humidity of the ink absorbing particles in the particle collect chamber 15. Here, the following liquid absorbing particles are used. The softening point thereof is 116° C. Specifically in FIG. 3, heating is performed for two hours by setting the heating temperature to 60° C. to lower the humidity.

(Ink Absorbing Particles)

Styrene/n-butyl methacrylate/acrylic acid copolymer (acid value: 110): 100 parts by weight Sodium hydroxide: 7.9 parts by weight Ion exchanged water: 1000 parts by weight The above materials are mixed and stirred. The resulting mixed liquid is dried using a spray drying apparatus (NL-5, manufactured by Ohkawara Kakohki Co., Ltd.), and classified with an air classifier to obtain particles.

Subsequently, to 100 parts by weight of the particles thus obtained, 0.25 parts by weight of amorphous silica (Aerosil RY200S, manufactured by Degussa, volume average particle size: 12 nm) and 0.75 parts by weight of amorphous silica (Aerosil A200, manufactured by Degussa, volume average particle size: 12 nm) are added, and mixed to prepare ink absorbing particles.

Figure 8:
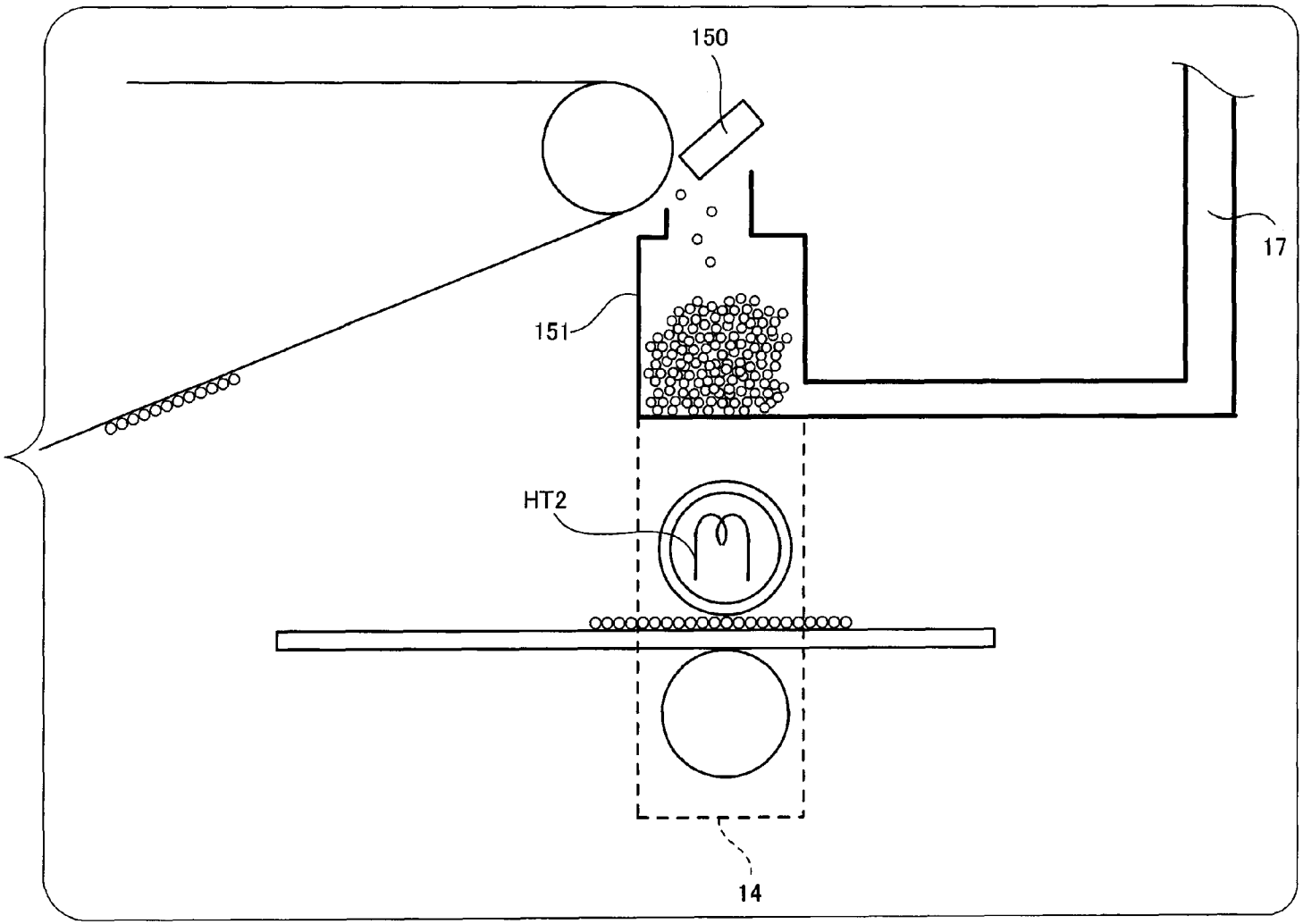
FIG. 8 is a diagram showing a configuration in which a particle collect chamber 151 is disposed above a case that houses a heater included in a fixing unit.

FIG. 8 is a diagram showing a configuration in which the particle collect chamber 151 is disposed above the case that houses the heater included in the fixing unit.

The configuration in FIG. 8 also uses the heat of the heater included in the fixing unit, like the configuration in FIG. 8.

For example, when the temperature of the case that houses the heater is 80° C., the particle collect chamber 15 is also heated. Supposing that outside temperature is 30° C. and relative temperature is 90%, then the temperature inside the particle collect chamber 15 can become a low humidity environment having the inside temperature of 60° C. and a low relative humidity of 20%. In this way, if the particle collect chamber 15 can become a low humidity environment, it is possible to lower the relative humidity of the collected ink absorbing particles 100*a* whose relative humidity has been increased with humidity absorption while being stored in the particle collect chamber 15.

Figure 9:
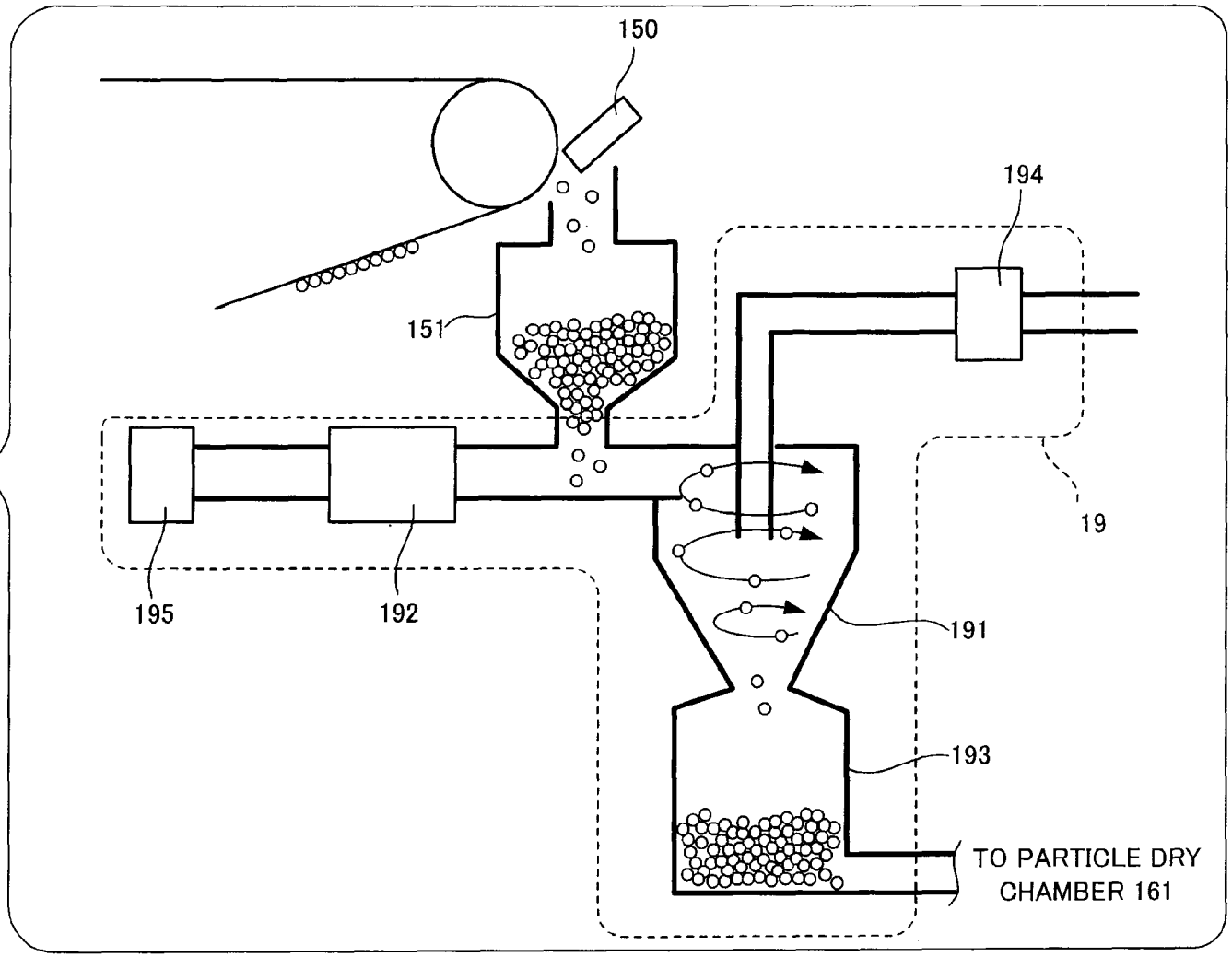
FIG. 9 is a diagram showing a configuration in which humidity adjustment of ink absorbing particles 100*a* is facilitated with the use of a humidity-adjustment facilitating unit 19.

FIG. 9 is a diagram showing an example in which a humidity-adjustment facilitating unit 19 having a dried air generating unit 192 and a cyclone generating unit 191 used for such as a cleaner are used.

In FIG. 9, since dried air is supplied to the cyclone generating unit 191 from the dried air generating unit 192, the ink absorbing particles 100*a* before being sent to the particle dry chamber 161 can make sufficient contact with the dried air, thereby following humidity adjustment in the particle dry chamber 161 is facilitated. Incidentally, since the ink absorbing particles 100*a* in the particle collect chamber 151 includes humidity, which may cause the congestion of particles, it is better to have a configuration that sends dried air from the dried air generating unit 192 to the cyclone generating unit 191 in order to separate congested ink absorbing particles, that once stores the ink absorbing particles in a temporal storage chamber 193, and that sends the ink absorbing particles to the particle dry chamber 161. FIG. 9 illustrates an example of providing air filters 194, 195 to disperse generated air to the outside.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling other skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an intermediate transfer member;

an ink absorbing particle supplying unit that supplies ink absorbing particles on a surface of the intermediate transfer member;

an ink ejecting unit that ejects ink in accordance with an image signal, to the ink absorbing particles supplied on the surface of the intermediate transfer member;

a transferring unit that transfers the ink absorbing particles that have absorbed the ink ejected on the intermediate transfer member from the ink ejecting unit to a recording medium, the transferring unit being disposed on a downstream side from the ink ejecting unit along a rotating direction of the intermediate transfer member;

a fixing unit that fixes the ink absorbing particles transferred to the recording medium on the recording medium;

a particle collecting unit that collects remaining ink absorbing particles on the intermediate transfer member, the particle collecting unit being disposed on a downstream side from the image transfer unit along the rotating direction of the intermediate transfer member;

a humidity reducing unit that reduces relative humidity around the ink absorbing particles collected by the particle collecting unit; and a collected particle supplying unit that supplies the collected ink absorbing particles with humidity reduced by the humidity reducing unit to the ink absorbing particle supplying unit;

wherein the fixing unit heats the ink absorbing particles, and the humidity reducing unit carries heat from the fixing unit, heats the ink absorbing particles collected by the particle collecting unit with the heat carried from the fixing unit, thereby reducing relative humidity around the ink absorbing particles.

2. The image forming apparatus according to claim 1, wherein the transfer unit transfers only the ink absorbing particles that have absorbed the ink ejected from the ink ejecting unit to a recording medium.

3. The image forming apparatus according to claim 1, wherein the ink absorbing particles are thermoplastic, and the humidity reducing unit heats the ink absorbing particles collected by the particle collecting unit at a temperature below a softening temperature of the ink absorbing particles.

4. The image forming apparatus according to claim 3, wherein the softening temperature of the ink absorbing particles is equal to or below 150° C.

5. The image forming apparatus according to claim 1, wherein the particle collecting unit further comprises a particle collect chamber that temporarily stocks the ink absorbing particles collected from the intermediate transfer member.

6. A method for forming an image, comprising:

supplying ink absorbing particles on a surface of an intermediate transfer member;

ejecting ink in accordance with an image signal, to the ink absorbing particles supplied on the surface of the intermediate transfer member;

transferring the ink absorbing particles that have absorbed the ink ejected on the intermediate transfer member from the ink ejecting unit to a recording medium;

fixing an image by fixing the ink absorbing particles transferred to the recording medium on the recording medium;

collecting remaining ink absorbing particles on the intermediate transfer member, after the ink absorbing particles are transferred to the recording medium by the transferring;

reducing relative humidity around the collected ink absorbing particles; and supplying the collected, humidity reduced ink absorbing particles for reuse;

wherein the fixing heats the ink absorbing particles, and the reducing carries heat from the fixing, heats the ink absorbing particles collected in the collecting with the heat carried from the fixing, thereby reducing relative humidity around the ink absorbing particles.

7. The method for forming an image according to claim 6, wherein the transferring transfers only the ink absorbing particles that have absorbed the ink ejected from the ejecting to a recording medium.

8. The method for forming an image according to claim 6, wherein the ink absorbing particles are thermoplastic, and the reducing heats the ink absorbing particles collected in the collecting at a temperature below a softening temperature of the ink absorbing particles.

9. The method for forming an image according to claim 8, wherein the softening temperature of the ink absorbing particles is equal to or below 150° C.

10. The method for forming an image according to claim 6, wherein the collecting temporarily stocks the humidity-absorbed particles collected from the intermediate transfer member in a particle collect chamber.

* * * * *